US012460815B2

(12) United States Patent
Cullum, Jr. et al.

(10) Patent No.: US 12,460,815 B2
(45) Date of Patent: Nov. 4, 2025

(54) FLAME RETARDING FLARE TIP

(71) Applicants: Robert L Cullum, Jr., Belle Chase, LA (US); Jewel W Woods, Corpus Christi, TX (US)

(72) Inventors: Robert L Cullum, Jr., Belle Chase, LA (US); Jewel W Woods, Corpus Christi, TX (US)

(73) Assignee: LIBERTY COMBUSTION TECHNOLOGIES LLC, Abita Springs, LA (US)

( * ) Notice: Subject to any disclaimer, the term of this patent is extended or adjusted under 35 U.S.C. 154(b) by 105 days.

(21) Appl. No.: 17/861,383

(22) Filed: Jul. 11, 2022

(65) Prior Publication Data

US 2024/0019121 A1 Jan. 18, 2024

Related U.S. Application Data

(60) Provisional application No. 63/308,414, filed on Feb. 9, 2022.

(51) Int. Cl.

| | |
|---|---|
| ***F23G 7/08*** | (2006.01) |
| ***F23D 14/70*** | (2006.01) |
| ***F23G 7/06*** | (2006.01) |

(52) U.S. Cl.
CPC ..... *F23G 7/085* (2013.01); *F23D 14/70* (2013.01); *F23G 7/065* (2013.01)

(58) Field of Classification Search
CPC . F23G 7/085; F23G 7/065; F23G 7/08; F23D 14/70
USPC ..... 431/202
See application file for complete search history.

(56) References Cited

U.S. PATENT DOCUMENTS 3,632,304 A * 1/1972 Hardison ..... F23G 7/07 422/177
3,730,673 A * 5/1973 Straitz, III ..... F23G 7/08 431/278
3,756,765 A * 9/1973 Sparrow ..... E21B 41/0071 422/168
4,128,389 A * 12/1978 Straitz, III ..... F23G 7/085 431/114

(Continued)

*Primary Examiner* — Vivek K Shirsat
(74) *Attorney, Agent, or Firm* — Ewing & Jones, PLLC

(57) ABSTRACT

A flame retarding flare tip, which belongs to the technical field of waste gas treatment resulting from fossil fuel production and aims at solving the technical problem of reducing the appearance of visible and further reducing smoke and gas is provided. According to the flame retarding flare tip, smoked butane, pentane, ethylene, propylene and the like can be subjected to smokeless combustion. Additionally, the flame retarding flare tip can reduce the appearance of visible flames. The invention has the technical scheme that at least a baffling system and at least one tip burner are respectively arranged in parallel in a dual-walled cylinder; the lower end of the cylinder is connected to a flare stack using an adjustable length pipe; an igniter tube is disposed on the portion of the adjustable length pipe that is contained within the cylinder; and a top cover for further preventing the appearance of visible flames and smoke and reduction of toxic gases. The flame retarding flare tip disclosed by the invention is used for treating waste gas resultant from fossil fuel production processes.

21 Claims, 5 Drawing Sheets

(56) References Cited

U.S. PATENT DOCUMENTS

| | | | | | |
|---|---|---|---|---|---|
| 5,380,195 | A * | 1/1995 | Reid | F23G 7/085 | 431/202 |
| 5,429,496 | A * | 7/1995 | Stephens | F23G 7/085 | 431/279 |
| 2021/0389023 | A1 * | 12/2021 | Salunkke | G10K 11/161 | |

* cited by examiner

FLAME RETARDING FLARE TIP

CROSS-REFERENCE TO RELATED APPLICATION

This application claims the benefit of U.S. Provisional Patent Application No. 63/308,414 filed Feb. 9, 2022, which is incorporated by reference herein in its entirety. APPENDIX The present application comprises an appendix labeled as "Appendix A" the entire contents of which are hereby incorporated by reference.

FIELD OF THE INVENTION

The embodiments disclosed herein relate generally to a flare tip assembly used in the combustion of gases in flare stacks for elimination of visible flames and the destruction of combustible vapors in various applications, including those on oil and gas production pads, crude oil tank batteries, midstream liquefied natural gas processing facilities, offshore platforms, and refining and petrochemical applications during normal and emergency operations. More particularly, the inventions claimed herein are related to novel systems and methods for eliminating visible flames and reducing toxic gases emanating from flaring tips.

BACKGROUND

If areas where companies extract oil and gas from shale and other formations, large, ominous-looking flames are readily visible from the tops of vertical pipes. The flames are a result of flaring, the loosely regulated practice of burning off unwanted byproduct gases of fossil fuel production. Industrial flares are designed to burn waste gas in a controlled manner and are used in a wide variety of industrial operations, including petroleum refining and chemical processing. Flares protect industrial sites and the adjacent communities by safely burning waste gas. Two major types of flares are the steam-assisted flare and the air-assisted flare, in which steam or air is injected at the flare tip.

Flaring somewhat reduces the amount of pollution released into the environment by burning and destroying waste gas instead of venting it directly to the atmosphere. Flares can also be used to burn and destroy waste gas from normal plant operations instead of releasing this gas to the atmosphere. Flares can be used during non-routine situations—such as power outages, emergency conditions, or plant-maintenance activities—to safely burn and destroy large volumes of waste gas in a controlled manner.

Typically, waste gasses are disposed of using a flare stack burner. Such burners having conventionally utilized a flare tip comprising a valve body, such as a Coanda body, that is either free floating or spring-loaded against an outlet or valve seat of a gas pipe. Pressurized waste gas lifts the valve body off the valve seat to form a variable opening through which the waste gas is discharged and ignited by a pilot burner to dispose of the waste gas.

The exit velocity of the gas through the variable opening changes in response to the displacement of the valve body off the valve seat. This occurs due to the variable load applied to the valve body by the spring. As pressure increases, the valve body is displaced further from the valve seat. The exit velocity of the gas past the spring-loaded flare tip increases as the square of the pressure.

While reducing some of the harmful gas into the atmosphere, gas flaring still introduces toxic pollutants such as sulfur dioxide into the atmosphere, which can lead to environmental problems such as acid rain, as well as the generation of greenhouse gases which contribute to global climate change. When the burning of natural gas occurs in close proximity to wildlife or inhabited areas, the effects raise potential environmental and health concerns.

Gas flaring contributes to climate change, which has serious implications for both Nigeria and the rest of the world. The burning of fossil fuel, mainly coal, oil and gas-greenhouse gases—has led to increasing world temperatures. In fact, gas flaring contributes to climate change by emission of carbon dioxide, the main greenhouse gas. Venting of the gas without burning, a practice for which flaring seems often to be treated as a synonym, releases methane, the second main greenhouse gas.

In view of the above-discussed environmental impacts, there is a need in the market for a flaring tip that reduces, if not eliminates, visible flames and reduces the harmful gases and smoke emanating from flare stacks.

BRIEF SUMMARY OF THE INVENTION

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

This disclosure presents a flame retarding flare stack, or gas flare, especially the tip portion thereof. The tip portion includes a baffling system to ensure clean burning to reduce or completely eliminate flames and harmful gases. The disclosed gas flare tip provides flameless and smokeless clean burning of released gases. The gas flare tip burns the released gases in a downward firing burning condition such that sufficient air is supplied to surges of gases. In addition, the flare tip is capable of handling both low- and high-pressure gases that have forced open relief valves. As such, different flow rates may be provided to the gas flare tip when different amounts of low-pressure and high-pressure flammable gases are mixed to provide a clean burning condition. The disclosed smokeless gas flare is thus environmentally friendly and aesthetically appealing.

In a general aspect, a flame retarding gas flare tip includes a baffling system having at least one baffle. Conveniently, the baffling system is formed in a tubular component of the flame retarding flare tip structure. In embodiments where multiple baffles are implemented, the baffles are equally spaced within the tubular component of an flame retarding flare tip structure. This spacing of the baffles permits air to flow into and mix with the unburned waste gas prior to combustion and this has been found particularly effective in suppressing flames and smoke and in maintaining stability. The baffles have a plurality of openings to aid in air flow.

The flame retarding gas flare tip further includes a flare tip burner. The flare tip burner is a single burner or arrangement of smaller burners fitted at the end of flare risers to safely ignite and burn all discharge of flare gas top cover for further repressing the appearance of visible flames and smoke. In one embodiment, the flare tip burner is a circular-shaped down firing flare tip burner.

The flame retarding gas flare tip further includes an adjustable length central pipe for connecting the flame retarding gas flare tip to a flare stack. In one embodiment, adjustable length central pipe is six inches in diameter and ten feet in length. In other embodiments, the adjustable length central pipe is longer or shorter depending on the required application.

In another specific aspect, the flame retarding gas flare tip further includes igniter tube for igniting the flare tip burner.

In yet another specific aspect, the flame retarding gas flare includes a top cover for further preventing the appearance of visible flames and smoke. The air and gases may be entrained inside the flame retarding gas flare tip without substantial overall movement when the mixed portion is burned away as quickly as the incoming gases.

Other aspects, features, and advantages will become apparent from the following detailed description when taken in conjunction with the accompanying drawings, which are part of this disclosure and which illustrate, by way of example, principles of the disclosures disclosed.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

Figure 1:
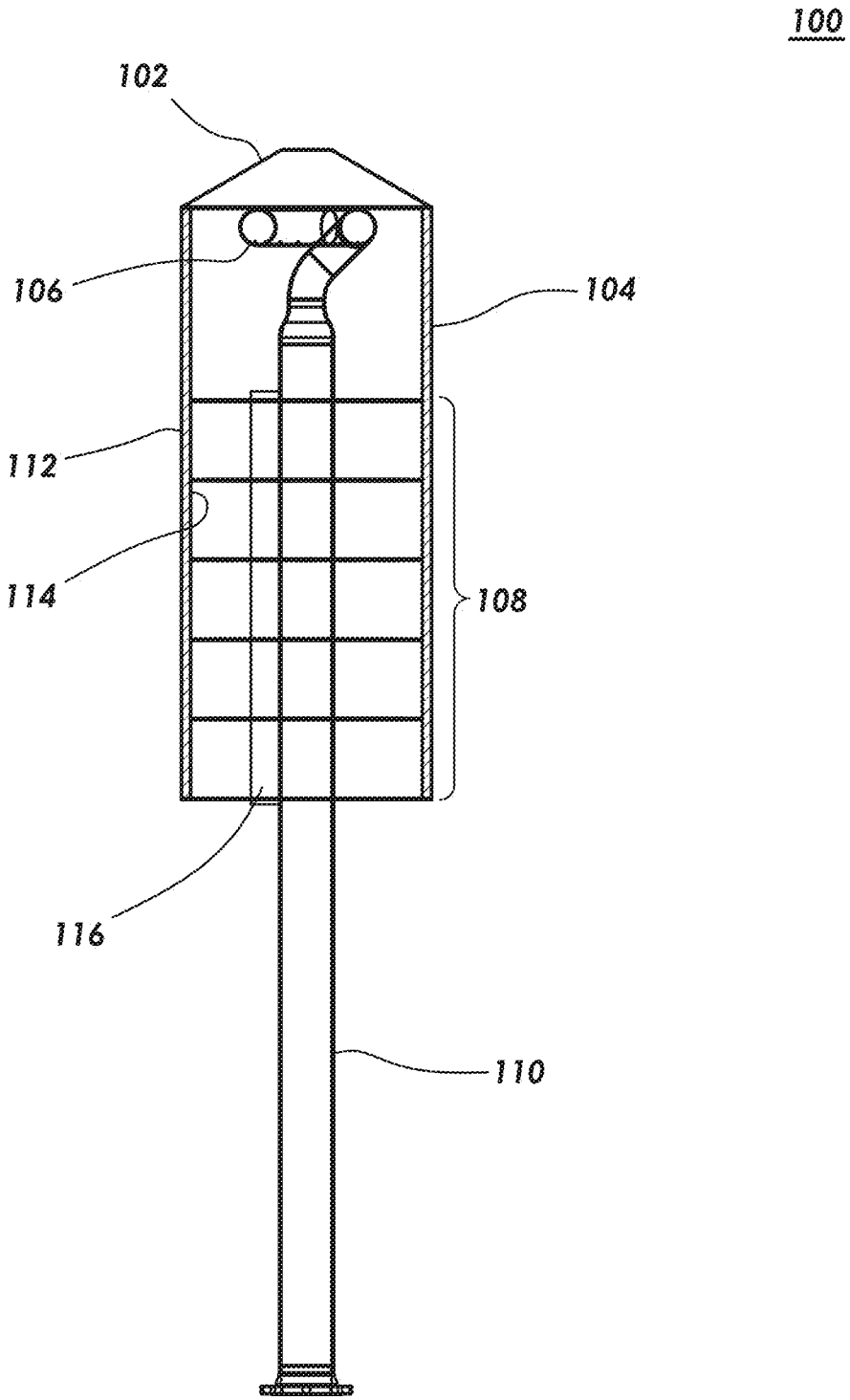
FIG. 1 is a schematic diagram of an exemplary flare tip, in accordance with embodiments of the invention.

The embodiments of the invention are described more fully hereinafter with reference to the accompanying drawings. Elements that are identified using the same or similar reference characters refer to the same or similar elements. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the invention may also be described using flowchart illustrations and block diagrams. Although a flowchart may describe the operations as a sequential process, many of the operations can be performed in parallel or concurrently. In addition, the order of the operations may be re-arranged. A process is terminated when its operations are completed but could have additional steps not included in a figure or described herein.

The present disclosure is to be considered as an exemplification of the invention and is in no way intended to limit the invention to the specific embodiments illustrated by the figures or description below.

At a high level, the flame retarding flare tip disclosed herein enables the reduction of visible flames resulting from flaring, improves clean burning and reduces black smoke, soot, or other contaminants due to incomplete burning. The disclosed flame retarding flare tip is configured to handle flammable gases at both low pressures and high pressures, as regulated and protected by pressure relief valves.

FIGS. 1-5 illustrate an embodiment of a flame retarding flare tip in detail. The present invention will now be described by referencing the appended figures representing preferred embodiments.

Figure 2:
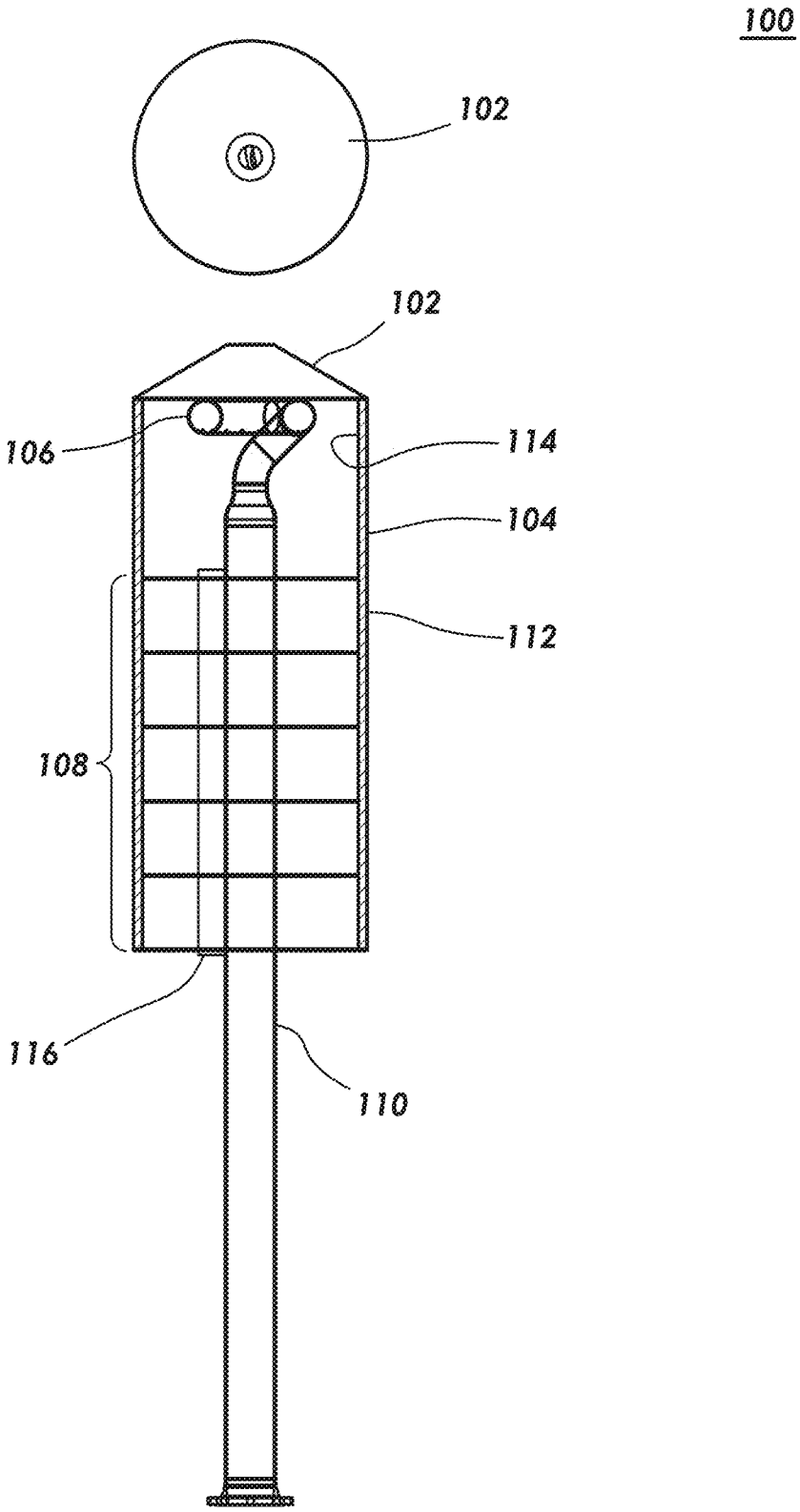
FIG. 2 is a schematic cross-sectional view of the flare tip, in accordance with embodiments of the invention.

FIGS. 1 and 2 depict an exemplary flame retarding flare tip 100 according to various embodiments of the present invention. The exemplary flame retarding flare tip 100. By way of background, a flare stack is a gas combustion device used in industrial plants such as petroleum refineries, chemical plants and natural gas processing plants. They are also common at oil or gas extraction sites having oil wells, gas wells, offshore oil and gas rigs and landfills.

In industrial plants, flare stacks are primarily used for burning off flammable gas released by safety valves during unplanned over-pressuring of plant equipment. During plant or partial plant startups and shutdowns, gas flares are also often used for the planned combustion of gases over relatively short periods. At oil and gas extraction sites, gas flares are similarly used for a variety of startup, maintenance, testing, safety, and emergency purposes. In a practice known as production flaring, they may also be used to dispose of large amounts of unwanted associated petroleum gas, possibly throughout the life of an oil well.

The exemplary flame retarding flare tip 100 includes a top cover 102, flare cover 104, tip burner 106, a baffling system 108 having at least one baffle, connection pipe 118 and igniter tube 120. The top cover 102 is placed on top of the flame retarding flare tip 100 to, inter alia, prevent infiltrating air from entering flare cover 104 and prevent the flame igniting system of the flame retarding flare tip 100 from being prematurely extinguished. The flare cover 104 is cylindrical in shape and serves to protect the interworkings of the flame retarding flare tip 100. The flare cover 104 has an outer wall 112 and inner wall 114 and is generally composed of stainless steel.

The dual-walled, stainless still construction of the flare cover 104 effectively regulates the temperature inside the flame retarding flare tip 100. One of ordinary skill in the art would readily recognize the use of stainless steels for flaring applications as their corrosion resistance and their high temperature properties are highly desirable. Therefore, stainless steels are prevalent in applications where high temperature oxidation resistance is necessary and in applications where, like here, high temperature strength is required. The high chromium content is beneficial to the wet corrosion resistance of stainless steels further benefiting the high temperature strength. The foregoing notwithstanding, one of ordinary skill in the art would understand additional materials could be used while maintaining the desired high temperature strength properties.

The tip burner 106 combines fuel and air at the velocities, turbulence and concentration required to establish and maintain proper ignition and stable combustion. The tip burner 106 is designed to give environmentally acceptable combustion of the vent gas over the flare system's capacity range. The tip burner 106 can be proprietary in design. Consideration is given to flame stability, ignition reliability, and noise suppression. The tip burner 106 can be a single point flare, multi-point flare, Coanda flare, vent tip flares. Single point flare tips are generally positioned vertically and connected to the end of an elevated flare riser/header. Offshore, single point flares are sometimes inclined when positioned on the end of a flare boom in order to direct the flare flame away from the operating platform. Further, single point flares can be either subsonic pipe flares or sonic single point flares.

Multi point flare tips are generally sonic flares and offer improved performance with respect to radiation, noise, and smokeless operation by routing the gas to a number of smaller diameter burner nozzles. Breaking up the gas flow into smaller streams enables greater air to hydrocarbon gas contact and therefore aeration of the flared gas in the combustion zone. Like single point flares, these flare tips are generally positioned vertically with a flanged connection at the top of an elevated flare riser/header.

Coanda flare tips use the Coanda effect to entrain large volumes of air into the gas stream, producing a single clean burning compact flame. The variable slot version of the design extends the effective operational range ensuring efficient operation at turndown conditions. Vent tips are generally an unignited single point flare either sonic or subsonic. Enclosed flares and many other types and derivatives of flares including steam assist, air assist, gas assist, low BTU and water injected flares are available.

The flame retarding flare tip 100 further includes an adjustable length connection pipe 110. The adjustable length connection pipe 110 connects the flame retarding flare tip 100 to a flare stack and is adjustable in both diameter and length to fit the desired application.

The flame retarding flare tip 100 further includes an igniter tube 116. The pilot burners have to be ignited and the igniter tube 116 is used for that purpose. More specifically, the function of the ignitor is to ignite the pilots, which in turn light the tip burner 110. Most flare tips have a minimum of three pilots equally spaced on the circumference of the flare tip. Further, pilots are often equipped with wind shields prevent wind and other debris from altering the operation of the pilot.

Figure 3:
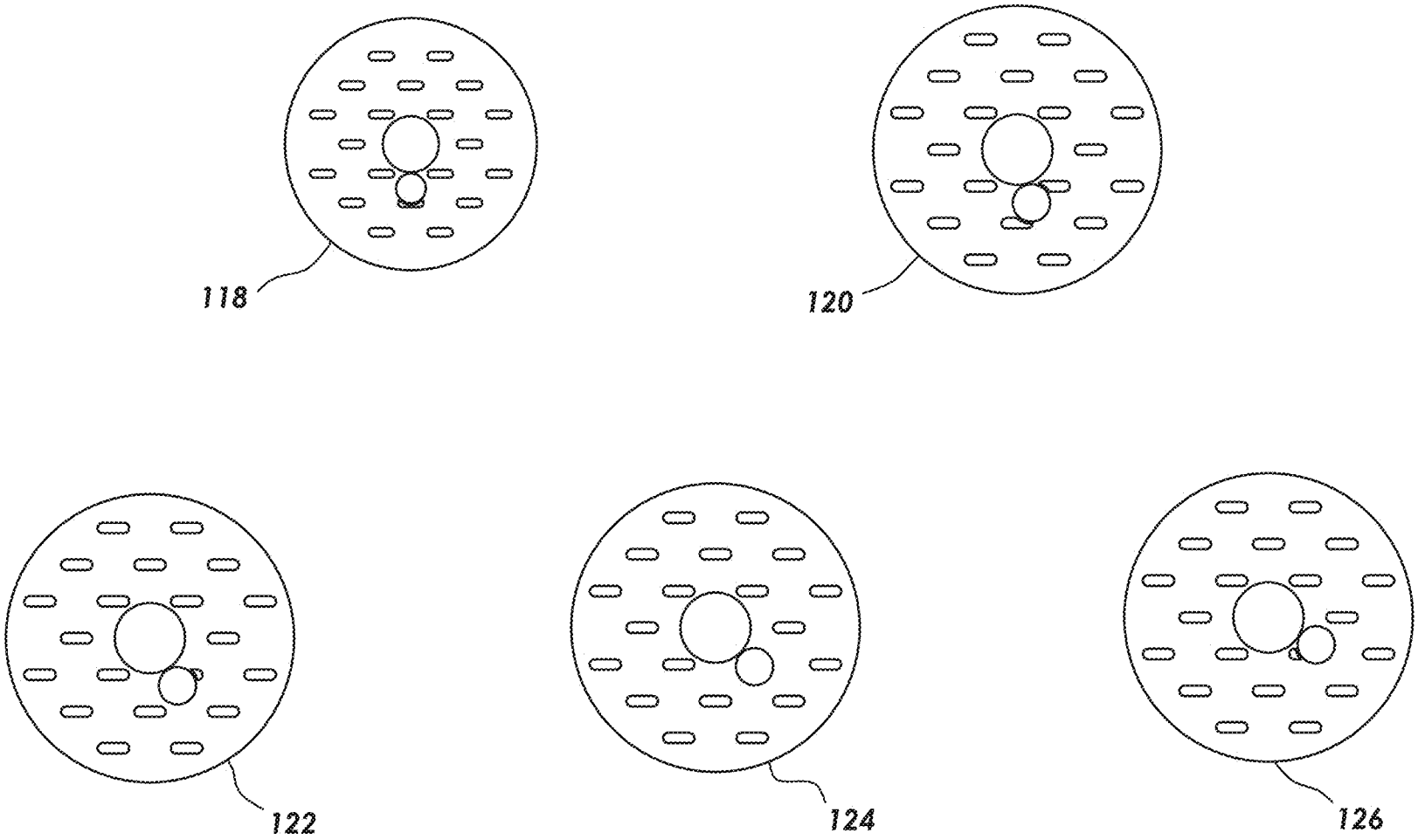
FIG. 3 is a schematic diagram of baffles found in an exemplary flare tip in accordance with embodiments of the invention.
Figure 4:
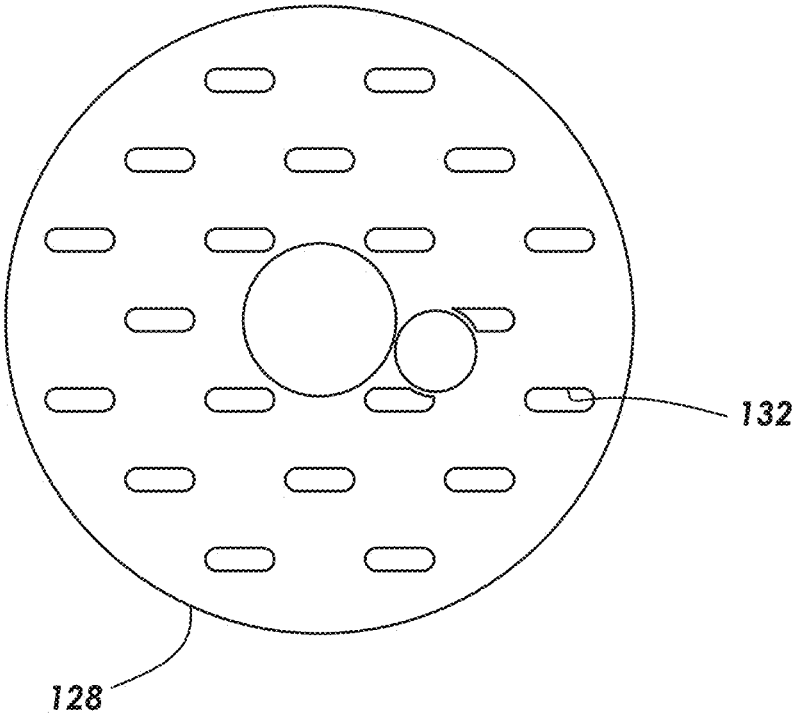
FIG. 4 is a schematic diagram of an exemplary baffle found in an exemplary flare tip in accordance with embodiments of the invention.
Figure 4:
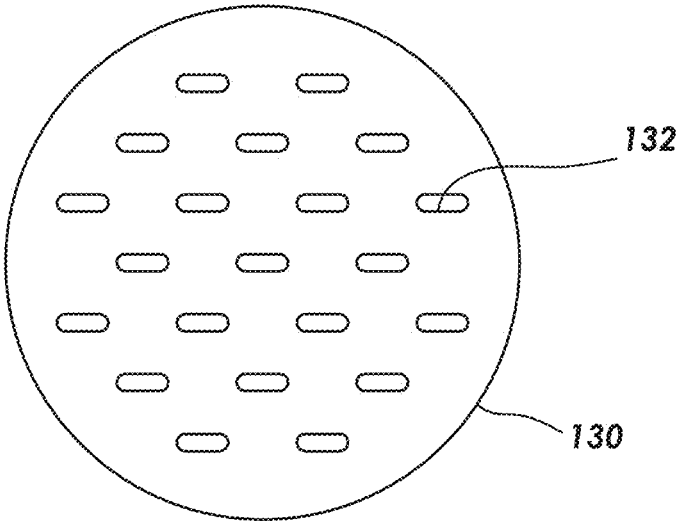

FIGS. 3 and 4 depict a schematic diagram of baffles found in the baffling system 108 in accordance with embodiments of the invention. The baffles disclosed herein are an integral part of the flame retarding flare tip 100. Baffles are flow-directing or obstructing vanes or panels used to direct a flow of liquid or gas. The baffles found in the baffling system described herein are typically used in industrial process vessels, such as shell and tube heat exchangers, chemical reactors, and static mixers.

Baffles are typically designed to support tube bundles and direct the flow of fluids for maximum efficiency. The baffle type of gas seal consists of a series of fixed baffles, shaped like open-ended cones, mounted within a flare tip. Air attempting to enter the stack is turned back against itself by the first baffle. Each succeeding baffle, with its progressively smaller aperture, further reduces the flow of air. The baffles disclosed in the baffling system 108 are arranged horizontally in the flare tip and are rotated in 15-degree increments if a multiple baffle configuration is used.

The flame retarding flare tip 100 further includes a baffling system 108 including at least one baffle. The number of baffles used in the flame retarding flare tip 100 is a function of the height of the flame retarding flare tip 100. In short, the taller the flame retarding flare tip 100 then number of baffles needed to retard the flame increases. In one embodiment of the flame retarding flare tip 100, baffles 118-130 are included in the flare cover 104 in the area bounded by the inner wall 114 of the flare cover 104. Baffles 118-130 reverse downward air flow in such a way that flow is choked off and swept out of the flare stack.

Further, baffles 118-130 serve to incrementally diminish the flame resulting from the flare tip combusting gases from the flare stack. More specifically, baffles 118-130 in the flame retarding flare tip 100 form at least a partial barrier to flames and air flow in an air path and a gas outlet. By forcing the flame through the baffles 118-130, the visible flame is incrementally restricted while permitting necessary air flow. Baffles 118-130 may extend substantially transversely across the flow path.

Baffles 118-130 of the baffling system 108 are provided with at least one perforation, slot, or other type of opening 132. The oblong-shaped slots in the baffles 118-130 permit the required air flow for maintaining a combustion operation while simultaneously reducing the appearance of visible flames and smoke. One of ordinary skill in the art would readily understand that the baffling system 108 described herein can include more or fewer baffles while still reducing the appearance of visible flames and smoke.

Figure 5:
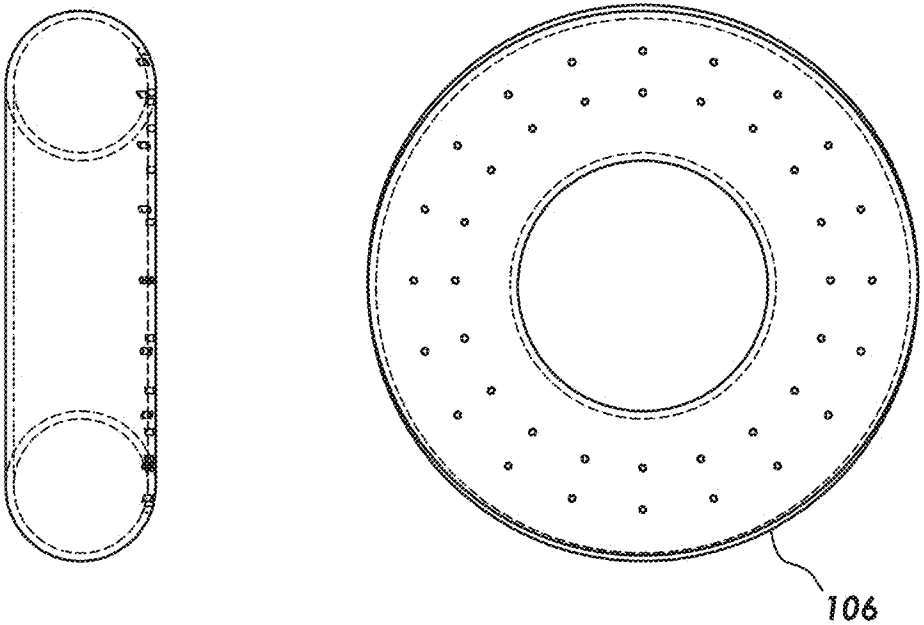
FIG. 5 is a schematic diagram of an exemplary tip burner found in an exemplary flare tip in accordance with embodiments of the invention.

FIG. 5 is a schematic diagram of an exemplary tip burner found in an exemplary flare tip 100 in accordance with embodiments of the invention. The tip burner 106 disclosed herein is a circular down-firing tip burner. Industrial burners classified as "down fired" are vertically oriented and located at the top of a furnace. In a multiple nozzle, directional flame control, oil and gas fired burner for cylindrical, vertical tube radiant type oil refinery heaters in which each nozzle comprises a tubular air-gas nozzle symmetrically mounted in a burner plate. The down fired burner tip for cylindrical, vertical tube radiant type oil refinery heaters in which each nozzle comprises a tubular air-gas nozzle symmetrically mounted in a burner plate. By using a down firing burner, the flame retarding nature of the invention is improved.

The disclosures made herein have been described in connection with what are presently considered to be the most practical and preferred embodiments and it is to be understood that the disclosure is not to be limited to the specifically disclosed embodiments, but on the contrary, is intended to cover various modifications and equivalent arrangements included within the spirit and scope of the disclosure(s).

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A flame retarding flare tip, comprising:

an outer covering;

a top cover;

a burner for igniting flare gas;

an upper baffle and a lower baffle, wherein the upper and lower baffles are each flat panels arranged horizontally in the outer covering and extending orthogonally to a flow path and each of the upper and lower baffles include a plurality of perforations through the upper and lower baffles; and means for connecting the flame retarding tip to a flare stack.

2. The flame retarding flare tip of claim 1 wherein the outer covering has an outer shell and an inner shell.

3. The flame retarding flare tip of claim 1 wherein the outer covering is cylindrical in shape with the upper baffle having the plurality of perforations dispersed around the upper baffle at multiple radii and distances from a center of the cylindrical shape.

4. The flame retarding flare tip of claim 1 wherein the outer covering is cylindrical in shape and the lower baffle has the plurality of perforations that are oblong-shaped.

5. The flame retarding flare tip of claim 1 further comprising at least one middle baffle in the space between the upper baffle and the lower baffle.

6. The flame retarding flare tip of claim 5 wherein the at least one middle baffle is perforated.

7. The flame retarding flare tip of claim 5 wherein the at least one middle baffle is perforated with oblong-shaped slots.

8. The flame retarding flare tip of claim 1 wherein the outer covering is comprised of stainless steel.

9. The flame retarding flare tip of claim 1 wherein the top cover is a top cone.

10. The flame retarding flare tip of claim 1 further comprising at least two baffles in the space between the upper baffle and the lower baffle.

11. The flame retarding flare tip of claim 10 wherein the at least two baffles in the space between the upper baffle and the lower baffle are all perforated.

12. The flame retarding flare tip of claim 1 further comprising at least three baffles in the space between the upper baffle and the lower baffle.

13. The flame retarding flare tip of claim 12 wherein the at least three baffles in the space between the upper baffle and the lower baffle are all perforated.

14. The flame retarding flare tip of claim 1 further comprising at least four baffles in the space between the upper baffle and the lower baffle.

15. The flame retarding flare tip of claim 14 wherein the at least four baffles in the space between the upper baffle and the lower baffle are all perforated.

16. The flame retarding flare tip of claim 1 further comprising at least five baffles in the space between the upper baffle and the lower baffle.

17. The flame retarding flare tip of claim 16 wherein the at least five baffles in the space between the upper baffle and the lower baffle are all perforated.

18. The flame retarding flare tip of claim 1 wherein the burner includes a tip burner.

19. The flame retarding flare tip of claim 1 wherein the burner is a down-firing tip burner.

20. The flame retarding flare tip of claim 1 wherein the burner is a circular-shaped down-firing tip burner.

21. The flame retarding flare tip of claim 1 further comprising an igniter tube.

* * * * *